US007083362B1

(12) United States Patent
Anonsen

(10) Patent No.: US 7,083,362 B1
(45) Date of Patent: Aug. 1, 2006

(54) BUOYANCY COMPENSATION COUPLING DEVICE (BCCD) AND METHOD OF INFLATION

(76) Inventor: James Anonsen, 61-3616 Kawaihae Rd., Kawaihae, HI (US) 96743

( * ) Notice: Subject to any disclaimer, the term of this patent is extended or adjusted under 35 U.S.C. 154(b) by 0 days.

(21) Appl. No.: 11/241,654

(22) Filed: Sep. 30, 2005

(51) Int. Cl.
*B63C 11/02* (2006.01)

(52) U.S. Cl. ..... 405/186; 441/96

(58) Field of Classification Search ..... 441/96, 441/92, 88; 405/186
See application file for complete search history.

(56) References Cited

U.S. PATENT DOCUMENTS

| | | | | |
|---|---|---|---|---|
| 3,536,071 | A | 10/1970 | Ferrando | |
| 3,727,250 | A | 4/1973 | Koehn et al. | |
| 3,747,140 | A | 7/1973 | Roberts | |
| 3,866,253 | A | 2/1975 | Sinks et al. | |
| 3,938,511 | A | 2/1976 | Roberts | |
| 3,991,785 | A | 11/1976 | Trinkwalder | |
| 4,000,534 | A | 1/1977 | Cerniway et al. | |
| 4,016,616 | A | 4/1977 | Walters | |
| 4,137,585 | A | 2/1979 | Wright | |
| 4,226,257 | A | 10/1980 | Trinkwalder | |
| 4,502,817 | A * | 3/1985 | Long et al. | 405/186 |
| 4,812,083 | A * | 3/1989 | Mosier | 405/186 |
| 5,417,204 | A * | 5/1995 | Moesle, Jr. | 128/205.23 |
| 5,520,485 | A * | 5/1996 | Hermansen | 405/186 |
| 5,584,287 | A * | 12/1996 | Smith et al. | 128/202.22 |
| 5,788,415 | A | 8/1998 | Chen | |
| 5,855,454 | A * | 1/1999 | Courtney et al. | 405/186 |
| 6,722,819 | B1 | 4/2004 | Godoy | |
| 6,761,163 | B1 * | 7/2004 | Toth | 441/96 |

* cited by examiner

*Primary Examiner*—Frederick L. Lagman

(57) ABSTRACT

The present invention includes an in-line device that improves safety and ease of use associated with a scuba diving buoyancy compensation device (BCD). Specifically, a rotational coupling and associated valves are provided to assist in closing the air passageway without physically disconnecting the air hose from the BCD for a diver in case of an emergency and may be utilized together with or independently from currently commercially available air hose configurations and is described as an improved buoyancy compensator coupling device (BCCD).

28 Claims, 2 Drawing Sheets

BUOYANCY COMPENSATION COUPLING DEVICE (BCCD) AND METHOD OF INFLATION

FIELD OF INVENTION

The present invention relates generally to equipment for use in limited oxygen environments or the like and, more particularly, to a scuba diver's buoyancy compensating device and appropriate connecting channel(s) for inflation and deflation of the buoyancy compensating device.

BACKGROUND OF THE INVENTION

The use of buoyancy compensation devices (BCDs) was to enable a scuba diver to maintain neutral buoyancy underwater and positive buoyancy on the surface, and is known in the technology associated with underwater activities. These BCDs contain one or more air chambers that can be inflated to facilitate upward movement of the diver, and deflated to accelerate the diver's descent. The BCD is inflated by using the air contained in the air cylinder(s) which are part of the diver's equipment. For inflation, the diver opens an appropriate valve specifically for this purpose. The air release from the BCD, on the other hand, is brought about by external pressure through a safety release valve or when the diver opens one or more discharge valves.

Traditional solutions regarding the need for proper BCD operation includes designs where the BCD is provided with a corrugated conduit, generally a tube of considerable flexibility, starting from the upper part of the BCD and provided at its free end with means for operating both the inflation and the deflation valves. The tube can be quite long and is secured on the lower rib cage in order that it remains positioned properly around the diver. Whenever the diver wishes to change his vertical position, the diver can access the end of the tube and operate the particular control, whether a button or a switch, that will bring about the desired volume change of the air chamber of the BCD.

It should here noted that a deflation of the BCD will diminish the diver's buoyancy and will therefore cause descent to a greater depth. As a general rule, this descent, which takes place rather slowly, does not imply any particular risks for the diver and the discharge valve may therefore be operated with relative freedom. The inflation of the BCD's air chamber, requires greater caution, since an excessive air inflow and a corresponding increase of the diver's buoyancy will cause a rapid upward movement with potentially dangerous consequences for the diver.

Given the situation presented, the appropriate instruction manuals and diving certification courses remind the diver that, on grasping the corrugated conduit of the conventional type, they should push the button on the power inflator device to allow air into the vest so you can float upwards and let air out of the vest by a multitude of means when they wish to drift downwards and descend further: in this way they will reduce the possibility of operating the wrong valve and the dangerous consequences that could stem there from, especially in emergency conditions. Inflation may also occur manually if necessary to allow the diver to rise toward the surface.

According to the conventional design and issues associated with inflation; inflation of the BCD is obtained by operating a push-button situated at the end of the corrugated conduit whether near the second stage regulator or near a control valve assembly, while deflation is produced by means of one or more of the following procedures: pulling the conduit away from the body, pressing of a push-button, or pulling a small cord that projects from the BCD. In each case, however, the diver must first find the operating means and this obliges them to make a more or less extensive movement or displacement of their arm.

Some BCD's are provided with a multiplicity of discharge valves and when the BCD has to be deflated, these can be opened simultaneously, using mechanical connection means that can be operated in the vicinity of the discharge valves. These valves generally are situated at the top side and bottom side of the BCD. In this manner, the diver can operate all these valves at the same time, choosing the position they find most comfortable according to the position of their hand.

In a situation where the buoyancy compensation device (BCD) is over inflating, or continues to inflate after diver demand has ceased, it is important for the diver to be able to removably detach any inflation supply air line that is attached between the compressed air tank and the BCD. Currently the normal procedure and design allows for use of a compressed air "quick disconnect" that with the manipulation (with several fingers of a hand) will disconnect the inflation air supply and the BCD. The quick disconnect may be near the inflation/deflation diver control. This invention by Roberts (U.S. Pat. No. 3,747,140) there is provided a quick disconnect and valve assembly including a coupling affixed to an underwater safety vest and adapted to be latched to a quick release connector attached to a scuba supply tank hose. The hose connector has a valve actuated by depressing a handle to supply air through the connector assembly to inflate the vest. When the assembly is unlatched, a spring urges quick release of the hose connector by forcing a tubular projection extending from the coupling out of mating engagement with a bore in the hose connector housing. A check valve in the coupling prevents escape of air from the vest.

This arrangement permits the vest to be inflated either from the scuba supply tank carried by the diver wearing the vest, or from the supply tank of a similarly equipped companion diver. A mouth tube permits the air in the vest to be breathed by the diver under emergency ascent conditions. The majority of the BCDS's including the power inflator and disconnect are located on the left side near the lower part of the rib cage such that the diver has to flex the adjacent arm at less than ninety degrees in order to find and pinch the coupling with the fingers and create a linear motion in the downward direction to uncouple the air line.

In terms of ergonomic efficiency bending the elbow to less than a ninety degree angle greatly reduces the strength of the hand and fingers. In an emergency situation, the ability to find, grasp and manipulate the disconnect compounds the difficulty regarding a possible immediate requirement that includes being able to quickly shut off the air source.

It is well known in the art that all the BCD's and/or other inflation/deflation devices are required by laws and regulations throughout the industrialized world to provide quick disconnect devices. All diver training requires divers to exhibit proficiency in manipulation of the quick disconnect. The present invention addresses a primary safety concern regarding the fact that it is known to those in the dive instruction field, that many divers have difficulty exhibiting the skill or strength or manual dexterity required to successfully manipulate the quick disconnect devices described above.

DESCRIPTION OF PRIOR ART

U.S. Pat. No. 3,536,071 to Ferrando, and assigned to Nemrod Metzler S A, describe a buoyancy compensating device fillable with an attached air canister.

U.S. Pat. No. 3,727,250 to Koehn, et. al., and assigned to Under Sea Industries, describes an underwater buoyancy device having an air chamber and an inflation/breathing tube communicating between the air chamber and an inflation/exhaust assembly, the chamber being inflatable with air supplied from a scuba tank via a hose, the assembly comprising a housing having coupling means providing flow communicating, quick-release connection to the hose, a mouthpiece formed in the same housing, an exhaust valve in the same housing for controlling air flow from the tube to the mouthpiece for breathing or for venting of the air chamber, a separately manually operable inflation valve in the housing for controlling air flow from the hose via a coupling means to the tube.

U.S. Pat. No. 3,747,140 to Roberts, and assigned to Under Sea Industries, describes a valving means for filling and deflating a buoyancy compensating device with a quick disconnect coupling for disassociating the air supply from the buoyancy compensating device.

U.S. Pat. No. 3,886,253 to Sinks, et. al., and assigned to Dacor Corp., describes an inflatable buoyancy vest for divers, comprising a flexible, hollow vest, first and second mutually separate inflatable compartments in said vest, first means for inflating said first compartment with CO2 gas, said first means including a holder attached to said vest for retaining a CO2 cartridge, second means for inflating said second compartment with air, a manually operated control valve connected to said second compartment for purging air there from, said control valve including a first outwardly facing annular valve seat, a first valve member movable against said seat, a tubular member fixed to said first valve member and having an internal valve seat surface, a second valve member axially mounted within said tubular member for movement against said valve seat surface, and a spring urging said first and second valve members into sealing engagement with the respective valve seats.

U.S. Pat. No. 3,938,511 to Roberts, and assigned to Under Sea Industries, describe a second stage regulator for scuba diving equipment having a valving means and controls for inflating and deflating a buoyancy compensating device.

U.S. Pat. No. 3,991,785 to Trinkwalder, and assigned to Sherwood-Selpac Corp., describe a fluid flow regulator coupled to said valve means for selectively moving said valve means to block and unblock fluid flow, with a valve design that by the mounting means provides mechanical advantage when moving the valve off the valve seat.

U.S. Pat. No. 4,000,534 to Cerniway, et. al. and assigned to US Divers Co. describes a buoyancy compensator for providing a diver with buoyancy gas comprising a vest with an inflation valve assembly at the other end of an airline tube having a mouthpiece connected to a valve housing, with a spring biased hand operated valve member for sealing against the interior of a housing to prevent the escape of gas there through and a relief valve connected to the vest for release of pressure within the cavity of said vest.

U.S. Pat. No. 4,016,616 to Walters, and assigned to Scott, Lawrence S., describe a Diver flotation apparatus with an adjustable weighting compartment that allows for a customizable change in the center of gravity.

U.S. Pat. No. 4,137,585 to Wright, and assigned to US Divers Co., describe a unit for filling a buoyancy compensator for conducting the flow of exhaust gas from a second stage regulator valving means interposed in the flow of exhaust gas for diverting the exhaust gas from the second stage regulator for flow into the conduit; and a means for connecting the conduit to a buoyancy compensator for inflation purposes.

U.S. Pat. No. 4,226,257 to Trinkwalder and assigned to Sherwood-Selpac Corp. describe a pressure regulator for maintaining a substantially constant output pressure level wherein the regulator contains linear valving.

U.S. Pat. No. 5,788,415 to Chen, and unassigned, describes a one-handed diving control valve system with controls for inflating and deflating a buoyancy compensation device that utilizes air from a second stage regulator and a quick disconnect coupling means for disassociating the valving from the air supply and also containing a diver warning device.

U.S. Pat. No. 6,722,819 to Godoy, and assigned to Cressi-Sub SpA, describes a device for operating inflation and deflation valves of an air chamber of a scuba diver's balancing jacket, the device comprising an actuator that permits the diver to operate the valves; and a handgrip projecting forwardly from a lower edge of the jacket at a side position, the actuator being situated on the handgrip, and the handgrip having a first sliding push-button that slides along the upper face of the handgrip for controlling the opening of the deflation valve, and a second push-button on its inner side face for controlling the opening of the inflation valve.

SUMMARY OF INVENTION

As detailed above, it is imperative for the user's safety, to be able to either disconnect the air supply from the BCD in an emergency situation in a safe and efficient manner or to control the air passage way such that even if the hose is not connected, the effect is the same. The present invention describes an improved safety valve system located in the air supply line to the power inflator and allows for either removeably disconnecting the air supply from the power inflator by use of a combination of a valve and rotational coupling or allowing the supply line to the BCD to remain connected but closed. The combination requires a threaded valve and associated valve opening connected to a normally closed valve so that when the rotational coupling is tightened the valve opening contacts and actuates the valve allowing for an opened channel so that air is allowed to pass between the air supply and the BCD. Conversely, when the rotational coupling is loosened, the valve actuation portion loses contact with the valve opening (actuator), thus closing the valve via a spring force (such as exists in a Schrader valve) thereby disconnecting the channel and blocking the flow of air to the power inflator. The present invention is therefore an improved buoyancy compensator coupling device (BCCD).

The inventive device has a rotational coupling for connecting, actuating/deactuating and optional separation of the air supply line to the power inflator.

The device's rotational coupling includes an easily gripped surface of the rotational coupling for the user to easily rotate the collar.

The present invention may be integral to the air supply line or retrofitted as a kit to existing air supply lines.

DETAILED DESCRIPTION OF THE DRAWINGS

Figure 1:
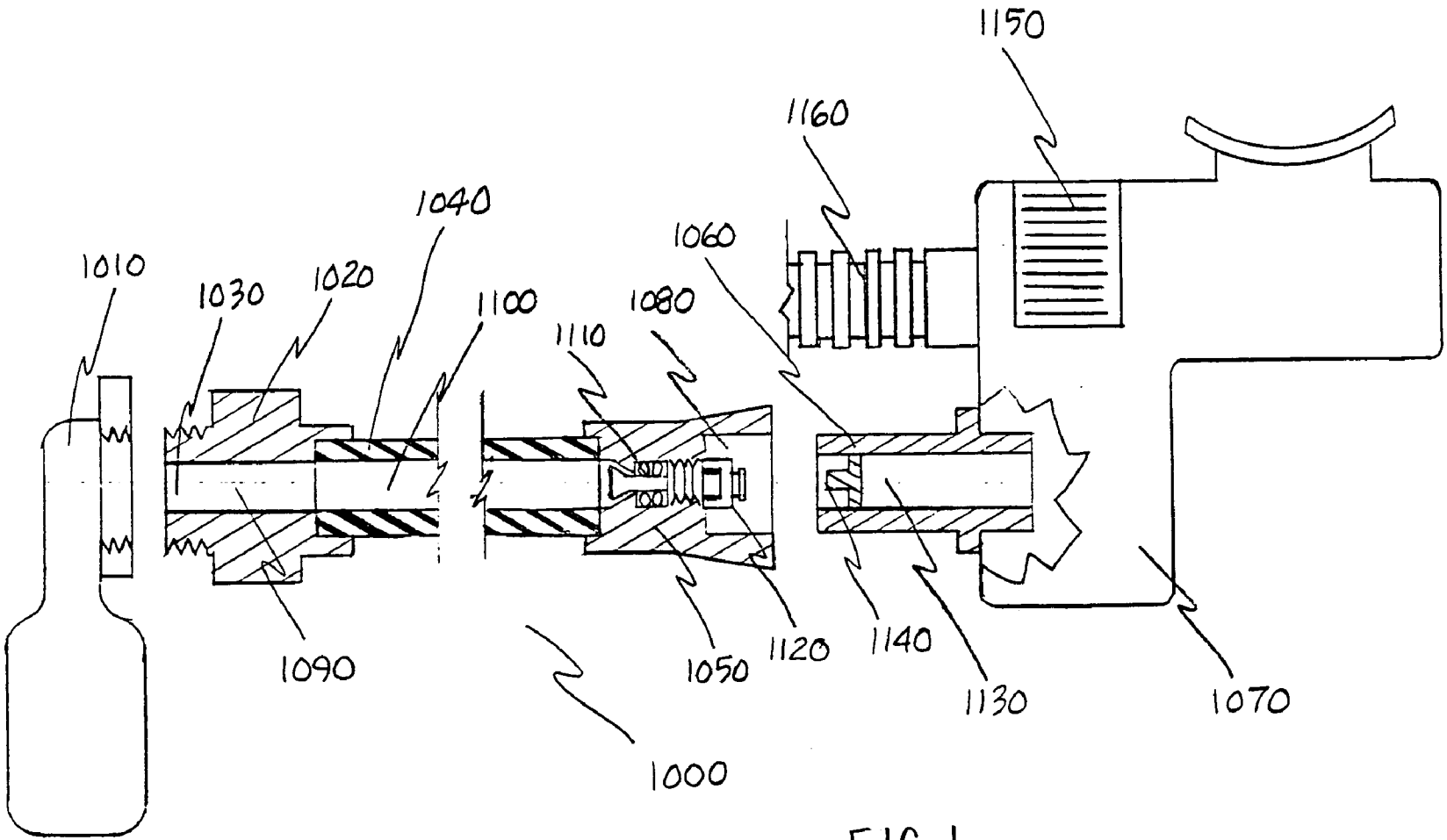
FIG. 1 PRIOR ART
FIG. 1 illustrates a typical air hose assembly used by divers that connects the compressed air tank to the power inflator which provides air to a buoyancy compensation device (BCD) and respirable air to the diver in an emergency situation or if otherwise necessary. This is not the inventive concept, but rather the current state of the art.

Referring now in detail to the illustrative embodiment of the existing art as depicted in the accompanying drawing, there is shown in FIG. 1, an air supply hose assembly [1000] which may be removeably attached to a pressurized air supply source or tank [1010] by a threaded coupling [1020] on the input end [1030], a hose [1040] and an optional quick disconnect coupling [1050] that is removeably attached to a power inflator post [1060] integral to the power inflator [1070] on the output end [1080] wherein activation of the power inflator button [1150] allows passage of air to the BCD (buoyancy control device) through a corrugated hose [1160].

The input end [1030] includes an inlet passage [1090] integral to the threaded coupling [1020] which connects with the hose [1040] and associated annular passage [1100]. The annular passage [1100] is continuous through the quick disconnect coupling [1050].

The quick disconnect coupling [1050] comprises a common Schrader valve assembly [1110] located axially in-line with the quick disconnect passageway [1120]. A power inflator post [1060] attached to the power inflator [1070] is removeably attached to the quick disconnect coupling [1050] and features an axial air passageway [1130] and a Schrader valve actuator [1140] in-line with the axial air passageway [1130] and attached to the power inflator post [1060]. When the quick disconnect coupling [1050] is attached to the power inflator post [1060] the Schrader valve actuator [1140] actuates the Schrader valve assembly [1110] in an open position creating a patent air flow passage allowing communication from the tank [1010] continuously to the power inflator [1070].

Figure 2:
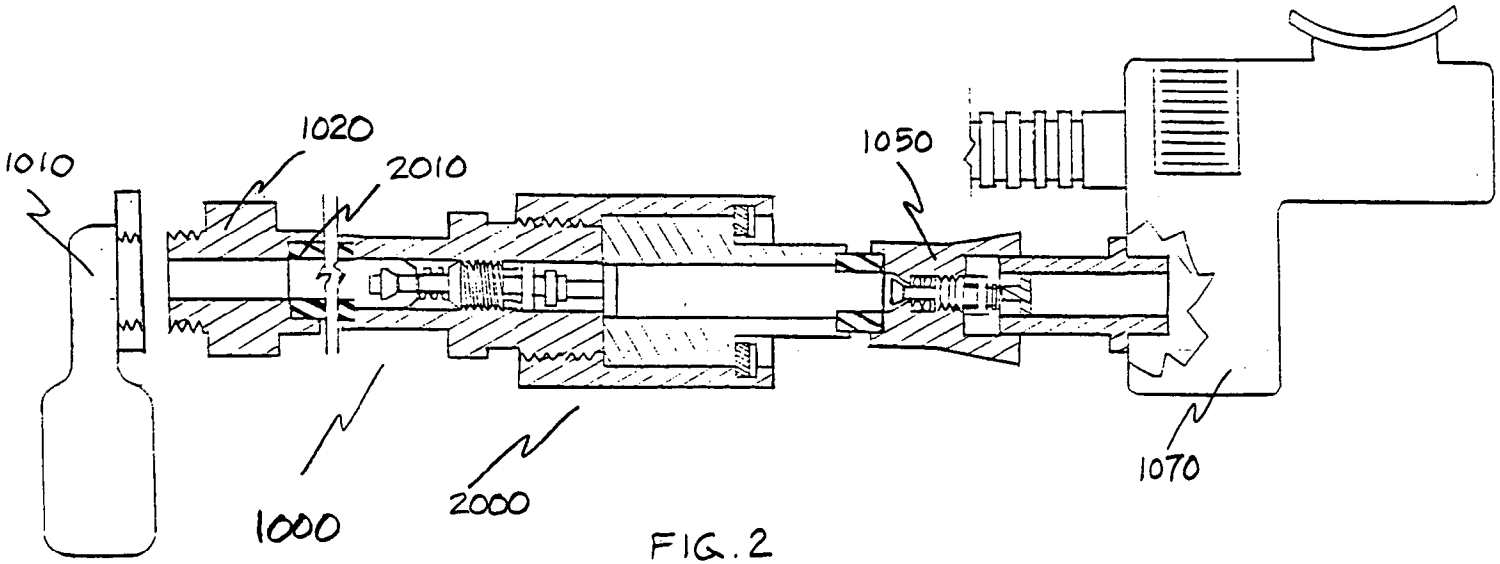
FIG. 2 details a typical air hose assembly with the rotational coupling inline in the preferred embodiment.

An embodiment of the present invention is described in FIG. 2 wherein the air supply hose assembly [1000] has incorporated a rotational coupling [2000] axially between the threaded coupling [1020] and the quick disconnect coupling [1050]. Additional configurations may include an air supply hose assembly [1000] wherein the rotational coupling [2000] is located between the quick disconnect coupling [1050] and the power inflator [1070] or the rotational coupling [2000] may be located between the threaded coupling [1020] and the tank [1010]. The rotational coupling [1020] may be permanently attached in one of the described configurations to the air supply hose [2010] or provided as a customizable kit.

Figure 3:
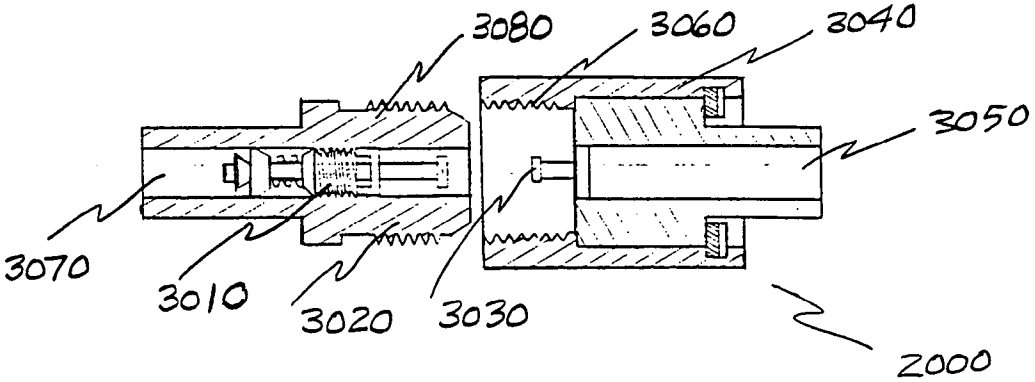
FIG. 3 is a sectional view of the rotational coupling and the location of the Schrader valve and the valve actuator.

For clarity, the rotational coupling [2000] is depicted in FIG. 3 wherein it incorporates a common Schrader valve assembly [3010] in the coupling male portion [3020] and a Schrader valve actuator [3030] in the coupling female portion [3040]. The coupling female portion [3040] comprises an axial annular hollow passageway [3050] to allow for air passage and internal threads [3060] to allow for attachment to the coupling male portion [3020]. The coupling male portion [3020] comprises a common Schrader valve assembly [3010] removeably attached in an axial passageway [3070] in a normally closed position as to not allow for the passage of air or fluids and external threads [3080] to allow for attaching to the coupling female portion [3040]. Attaching the coupling female portion [3040] and the coupling male portion [3020] by joining the external threads [3080] and the internal threads [3060] and tightening by rotation of the coupling female portion [3040] over the coupling male portion [3020] until the Schrader valve actuator [3030] contacts and actuates the common Schrader valve assembly [3010] opening the common Schrader valve assembly [3010] creating a patent or non-restricted air flow passageway. Inversely the coupling female portion [3040] and the coupling male portion [3020] may be detached by rotationally loosening the coupling female portion [3040] from the coupling male portion [3020]. Detaching the coupling female portion [3040] from the coupling male portion [3020] releases contact of the Schrader valve actuator [3030] with the common Schrader valve assembly [3010] allowing the common Schrader valve assembly [3010] to assume a normally closed position thereby obstructing or restricting the annular hollow passageway [3070]. It as an object of this invention that the coupling male portion [3020] need not be fully detached from the coupling female portion [3040] in order to cause the Schrader valve actuator [3030] to lose contact with the common Schrader valve assembly [3010] thus closing the common Schrader valve assembly [3010] and thereby restricting or stopping air flow.

What is claimed is:

1. A buoyancy compensator coupling device providing a diver with buoyancy gas comprising;

an air supply hose assembly that includes a rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling such that said common Schrader valve assembly removeably attaches to an axial annular hollow gas passageway provided within said rotational coupling, and wherein said passageway is in a normally closed position thereby obstructing or restricting said axial annular hollow passageway even though said coupling male portion is not fully detached from said coupling female portion.

2. A buoyancy compensator coupling device of claim 1, wherein said Schrader valve actuator can lose contact with said common Schrader valve assembly thus closing said common Schrader valve assembly such that said axial annular hollow gas passageway is partially or fully restricted.

3. The buoyancy compensator coupling device of claim 1, wherein external threads of said coupling male portion of said rotational coupling exist and allow for attachment to internal threads of said coupling female portion of said rotational coupling and wherein attachment of said coupling female portion of said rotational coupling and said coupling male portion of said rotational coupling is accomplished by joining said external threads of said coupling male portion and internal threads of said female coupling portion by tightening by rotation of said coupling female portion with said coupling male portion of said rotational coupling until said Schrader valve actuator contacts and actuates said common Schrader valve assembly thereby creating a non-restricted air flow passageway.

4. The buoyancy compensator coupling device of claim 1, wherein said device remains mated in that said coupling male portion need not be fully detached from said coupling female portion to accomplish said restricted air flow passageway.

5. The buoyancy compensator coupling device of claim 1, wherein said coupling female portion and said coupling male portion of said rotational coupling may be detached by rotational loosening said coupling female portion from said coupling male portion thereby releasing contact of said Schrader valve actuator with said common Schrader valve assembly and allowing said common Schrader valve assembly to assume a normally closed position thereby completely obstructing said axial annular hollow passageway.

6. The buoyancy compensator coupling device of claim 1, wherein said quick disconnect coupling is not optional.

7. The buoyancy compensator coupling device of claim 1, wherein said rotational coupling is preferably between 0.75 and 1.25 inches in diameter.

8. The buoyancy compensator coupling device of claim 1, wherein said rotational coupling includes an exterior surface texture that is not smooth and more preferably knurled.

9. The buoyancy compensator coupling device of claim 1, wherein said materials of construction, including all coupling and valves and respective assemblies are corrosion resistant and wherein said materials may be metallic or non-metallic.

10. The buoyancy compensator disconnect device of claim 1, wherein said rotational coupling is located between a quick disconnect coupling and a power inflator said rotational coupling may be located between said Schrader valve assembly and an air supply hose wherein said rotational coupling may be permanently attached to said supply hose assembly or provided as a customizable kit, wherein said kit comprises an air supply hose, a rotational coupling and a threaded coupling.

11. A buoyancy compensator coupling device kit, wherein said device kit can be supplied as a separate kit such that said kit comprises an air supply hose assembly that includes a complete rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling and a gas supply hose with a fitting on one end to connect with an appropriate portion of a gas supply and another end to attach with said complete rotational coupling or said complete rotational coupling and said quick disconnect assembly.

12. The buoyancy compensator coupling device kit of claim 11, wherein said kit includes said complete rotational coupling or said complete rotational coupling and said quick disconnect assembly.

13. The buoyancy compensator disconnect device kit of claim 11, wherein said gas supply hose of said kit is rated at or above 200 psi.

14. An air supply hose assembly providing a diver with buoyancy gas wherein said air supply hose assembly includes a rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling such that said common Schrader valve assembly removeably attaches to an axial annular hollow gas passageway provided within said rotational coupling, and wherein said passageway is in a normally closed position thereby obstructing said axial annular hollow passageway even though said coupling male portion is not fully detached from said coupling female portion.

15. The air supply hose assembly of claim 14, wherein external threads of said coupling male portion of said rotational coupling exist and allow for attachment to internal threads of said coupling female portion of said rotational coupling and wherein attachment of said coupling female portion of said rotational coupling and said coupling male portion of said rotational coupling is accomplished by joining said external threads of said coupling male portion and internal threads of said female coupling portion by tightening by rotation of said coupling female portion with said coupling male portion of said rotational coupling until said Schrader valve actuator contacts and actuates said common Schrader valve assembly thereby creating a non-restricted air flow passageway.

16. The air supply hose assembly of claim 14, wherein said Schrader valve actuator can lose contact with said common Schrader valve assembly thus closing said common Schrader valve assembly such that said axial annular hollow gas passageway is fully restricted.

17. The air supply hose assembly of claim 14, wherein said assembly remains mated in that said coupling male portion need not be fully detached from said coupling female portion to accomplish said restricted air flow passageway.

18. The air supply hose of claim 14, wherein said coupling female portion and said coupling male portion of said rotational coupling may be detached by rotational loosening said coupling female portion from said coupling male portion thereby releasing contact of said Schrader valve actuator with said common Schrader valve assembly and allowing said common Schrader valve assembly to assume a normally closed position thereby completely obstructing said axial annular hollow passageway.

19. The air supply hose of claim 14, wherein said quick disconnect coupling is not optional.

20. The air supply hose of claim 14, wherein said rotational coupling is preferably between 0.75 and 1.25 inches in diameter.

21. The air supply hose of claim 14, wherein said rotational coupling includes an exterior surface texture that is not smooth and more preferably knurled.

22. The air supply hose of claim 14, wherein said materials of construction, including all coupling and valves and respective assemblies are corrosion resistant and wherein said materials may be metallic or non-metallic.

23. The air supply hose of claim 14, wherein said rotational coupling is located between a quick disconnect coupling and a power inflatoror said rotational coupling may be located between said Schrader valve assembly and an air supply tank wherein said rotational coupling may be permanently attached to said supply hose assembly or provided as a customizable kit, wherein said kit comprises an air supply hose, a rotational coupling and a threaded coupling.

24. A buoyancy compensator device comprising;

a) a vest having a collar and an opening through which a user's head can pass; straps attached to said vest for maintaining said vest on a user's body;

b) a filling means comprising a flexible tube connected to an interior of said vest at one end of said tube, with an inflation valve assembly at the other end of said tube having a mouthpiece connected to a valve housing, with a spring biased hand operated valve member for sealing against an interior of said housing to prevent escape of gas therethrough connected to an operating member at least partially exposed extrinsically to said housing, so that when said valve member is moved from said valve housing by said operating member, it will permit inflation of said vest wherein said said flexible tube and connection is known as a power inflator;

c) a fitting passing from said interior of said vest to said exterior thereof to provide a housing on said exterior of said fitting having a passage through said housing and said fitting;

d) a valve cover attached to said housing for covering an opening of said housing;

e) spring biasing means for maintaining said valve cover in a normally closed position;

f) an opening operably connected to said valve cover to provide manual displacement of said valve cover against said spring biasing means; and;

g) a coupling device providing a diver with buoyancy gas comprising an air supply hose assembly that includes a rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling such that said common Schrader valve assembly removeably attaches to an axial annular hollow gas passageway provided within said rotational coupling, and wherein said passageway is in a normally closed position thereby obstructing said axial annular hollow passageway even though said coupling male portion is not fully detached from said coupling female portion.

25. A method of using a buoyancy compensator coupling device providing a diver with buoyancy gas comprising; an air supply hose assembly that includes a rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling such that said common Schrader valve assembly removeably attaches to an axial annular hollow gas passageway provided within said rotational coupling, and wherein said passageway is in a normally closed position so as not to allow for passage of gas or fluids and wherein manipulating said rotational coupling by said diver with simply a thumb and index finger of either hand of said diver allows for fully controlling a flow of gas through said annular hollow gas passageway.

26. The method of claim 25, wherein said coupling device allows for turning in either a clockwise or counterclock-wise fashion wherein a left-handed thread is preferred.

27. A system involving a buoyancy compensator coupling device providing a diver with buoyancy gas comprising; an air supply hose assembly that includes a rotational coupling located axially between a threaded coupling and an optional quick disconnect coupling, wherein said rotational coupling itself comprises both a common Schrader valve assembly including a coupling male portion of said rotational coupling and a Schrader valve actuator with a coupling female portion of said rotational coupling such that said common Schrader valve assembly removeably attaches to an axial annular hollow gas passageway provided within said rotational coupling, and wherein said passageway is in a normally closed position thereby restricting said axial annular hollow passageway even though said coupling male portion is not fully detached from said coupling female portion.

28. The system of claim 27, wherein said coupling device allows for turning in either a clockwise or counterclockwise fashion wherein a left handed thread is preferred.

* * * * *

UNITED STATES PATENT AND TRADEMARK OFFICE

CERTIFICATE OF CORRECTION

PATENT NO. : 7,083,362 B1
APPLICATION NO. : 11/241654
DATED : August 1, 2006
INVENTOR(S) : James Anonson It is certified that error appears in the above-identified patent and that said Letters Patent is hereby corrected as shown below:

On Title Page, Item (74) Should read,
Attorney, Agent of Firm - Guerry L. Grune

Signed and Sealed this

Sixth Day of February, 2007

JON W. DUDAS
*Director of the United States Patent and Trademark Office*